US006241575B1

(12) United States Patent
Shailer

(10) Patent No.: US 6,241,575 B1
(45) Date of Patent: Jun. 5, 2001

(54) BRASSIERE HAVING INTEGRATED INFLATABLE BLADDERS FOR THE HOLDING OF COMESTIBLE LIQUIDS

(75) Inventor: Tracy B. Shailer, Fort Lauderdale, FL (US)

(73) Assignee: BoobieFlask, Inc., Fort Lauderdale, FL (US)

( * ) Notice: Subject to any disclaimer, the term of this patent is extended or adjusted under 35 U.S.C. 154(b) by 0 days.

(21) Appl. No.: 09/597,070

(22) Filed: Jun. 20, 2000

(51) Int. Cl.[7] ..... A41C 3/10

(52) U.S. Cl. ..... 450/38; 450/57; 2/69; 224/148.1

(58) Field of Search ..... 450/1, 38, 57, 450/54–56, 58; 2/1, 311, 312, 338, 267, 268, 69, 115, 105, 106, 117, 69.5, DIG. 3; 224/148.1, 148.2, 148.3, 148.4, 148.5, 148.6, 600, 627, 637, 638; 222/175, 386.5, 401; 4/616, 618; 623/7, 8

(56) References Cited

U.S. PATENT DOCUMENTS 2,684,787 * 7/1954 Charpiat ..... 224/148.1
4,139,130 * 2/1979 Glusker et al. ..... 2/312
5,060,833 * 10/1991 Edison et al. ..... 224/148.1
5,823,852 * 10/1998 Chu ..... 450/38
5,864,880 * 2/1999 Adam ..... 2/69
5,940,880 * 8/1999 Phillips ..... 2/7
6,132,288 * 10/2000 Aerts ..... 450/38

* cited by examiner

*Primary Examiner*—Gloria M. Hale
(74) *Attorney, Agent, or Firm*—Melvin K. Silverman

(57) ABSTRACT

Cups of a bra include integrated flexible bladders formed of a medical grade material having sufficient fluid integrity to hold a comestible liquid. The bladders may include a fabric sleeve. Each bladder is provided with an inlet, for purposes of filling, and an outlet for purposes of consumption. Alternatively, bladders having an appropriate geometry are filled by a manufacturer of the comestible liquid such that only an outlet is necessary. In all forms, the outlet communicates with a flexible narrow straw having a cross section which is preferably flat and elliptical. The bladder inlet is typically located at a portion of the bladder facing closest to the vertical axis of the body, while the outlet is advantageously positioned at the lowestmost point of the bladder to gain the fullest benefit of gravity on fluid flow through the outlet tube which, during periods of non-use, may be hidden in a number of ways, these including wrapping about the periphery of the bra cup itself, placing the tube underneath a bra strap, and placing the tube along the back of the user where one is wearing an article of clothing, such as a blouse, tank top, or bikini top which will hide such tube. A variety of accessories are provided to facilitate filling the bladders and drinking of the contents.

17 Claims, 6 Drawing Sheets

BRASSIERE HAVING INTEGRATED INFLATABLE BLADDERS FOR THE HOLDING OF COMESTIBLE LIQUIDS

BACKGROUND OF THE INVENTION

The brassiere (hereinafter referred to simply as "bra") has existed, in one form or another, for centuries. However, to the knowledge of the within inventor, there has never existed, nor otherwise been suggested, a bra having, integrated into the cup portions thereof, bladders, or the like, capable of holding a comestible liquid such as water, juice, Power-aid or an alcoholic beverage. That is, all known enhancements or modifications of cup portion of a bra have related to means of improving either or both the comfort thereof to the wearer or furnishing a cosmetically desirable appearance thereto. Sealed packets of non-comestible gels have been sewn into bra cups for purpose of comfort and appearance.

While it may appear self-evident that a comestible liquid such as water, juice, Power-aid or an alcoholic beverage should, if desired, be contained within a cup, bottle, flask or the like, there exist social situations in which it is simply inappropriate for one to carry within one's possession, upon one's person, or within a handbag such a container. Particularly if the same comprises a container/flask of an alcoholic beverage. Also, at certain events, for example, athletic events, the level of activity and excitement is often such that it is impractical to hold or use a conventional cup, container, or flask. Thereby, a need has arisen in the art for a means of intergration into an article of clothing containment means for a comestible liquid. More particularly, it has been determined by the inventor that limited amounts of such liquid may be practically stored within the structure of an otherwise conventional bra to thereby avoid the inconvenience and potential embarrassment (in the case of an alcoholic beverage) that would otherwise be involved if one were to openly carry about such a container, particularly within various socially sensitive environments.

The instant invention may therefore be viewed as a response to the above set forth long existing need in the art.

SUMMARY OF THE INVENTION

The invention is directed to a bra having integrated into the cups thereof flexible bladders formed of a medical grade material having sufficient fluid integrity to hold a comestible liquid. The bladders may include a fabric sleeve. In a first embodiment thereof, each bladder is provided with an inlet, for purposes of filling, and an outlet for purposes of consumption. In a second embodiment, bladders having an appropriate geometry are filled by a manufacturer of the comestible liquid such that only an outlet is necessary. In all embodiments, the outlet communicates with a flexible narrow straw having a cross section which is preferably flat and elliptical. The bladder inlet is typically located at a portion of the bladder facing closest to the vertical axis of the body, while the outlet is advantageously positioned at the lowest-most point of the bladder to gain the fullest benefit of gravity on fluid flow through the outlet tube which, during periods of non-use, may be hidden in a number of ways, these including wrapping about the periphery of the bra cup itself, placing the tube underneath a bra strap, and placing the tube along the back of the user where one is wearing an article of clothing, such as a blouse, tank top, or bikini top which will hide such tube. A variety of accessories are provided to facilitate filling the bladders and drinking of the contents thereof.

It is accordingly an object of the present invention to provide an improved bra capable of holding, internally therewith, a comestible liquid such as water, juice, Power-aid or an alcoholic beverage.

It is a further object to provide a means of holding a liquid, the appearance within which a conventional container would not be considered socially appropriate.

It is another object of the invention to provide a pre-filled bladder for adapted for selectable attachment to an inner surface of a bra cup.

It is a yet further object to provide a bra-related accessory of the above type for use in the containment of a medicinal liquid.

It is a further object of the invention to provide a bladder for insertion into a cup of a bra in which different liquids may be held in different cups of bladders thereof.

It is a further object to provide a bra of the above type in which drinking tubes thereof may be effectively camouflaged during periods of non-use of the system.

The above and yet other objects and advantages of the present invention will become apparent for the hereinafter set forth Brief Description of the Drawings, Detailed Description of the Invention, and Claims appended herewith.

DETAILED DESCRIPTION OF THE INVENTION

Figure 1:
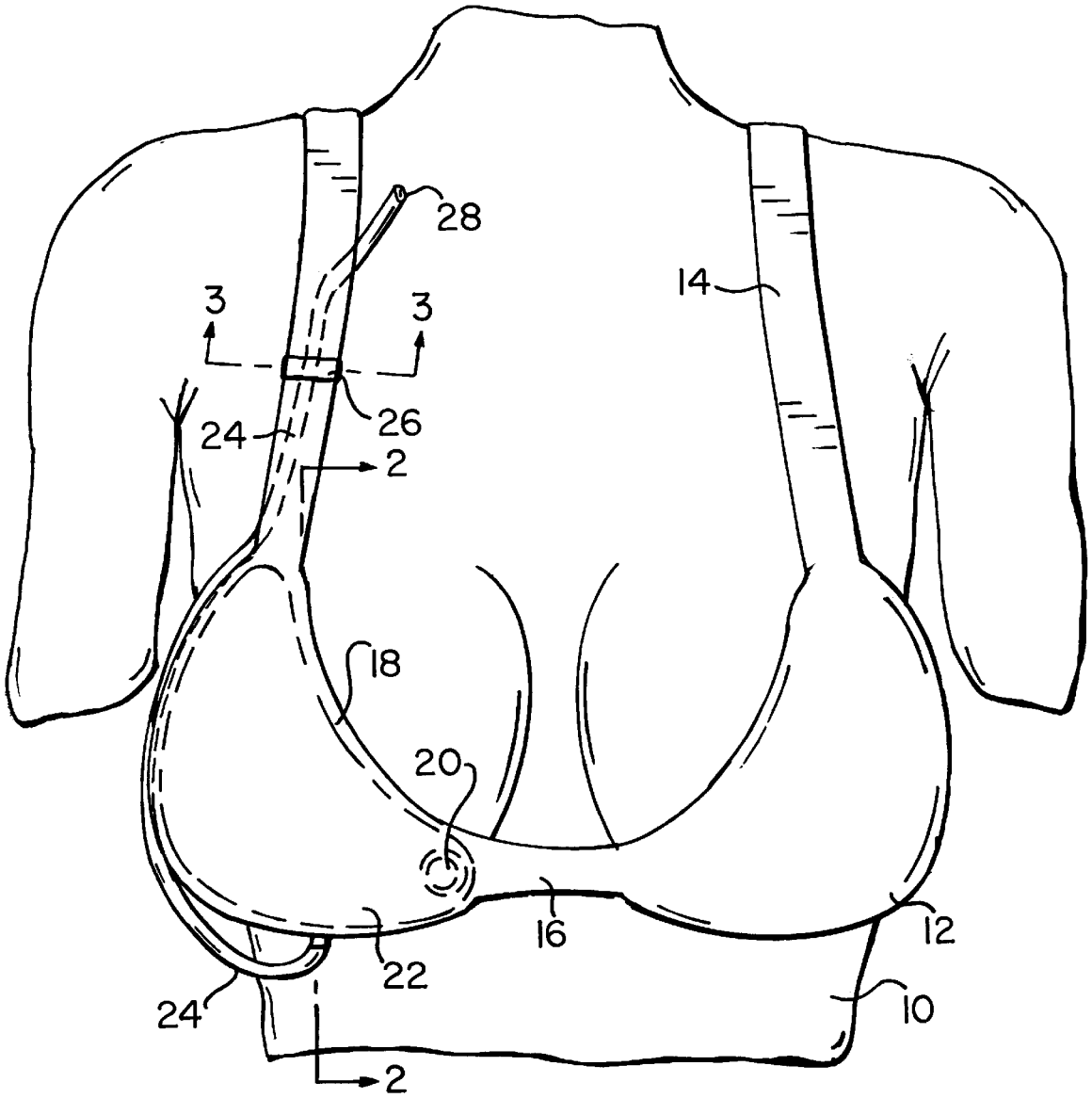
FIG. 1 is a front schematic view of a first embodiment of the inventive system.
Figure 2:
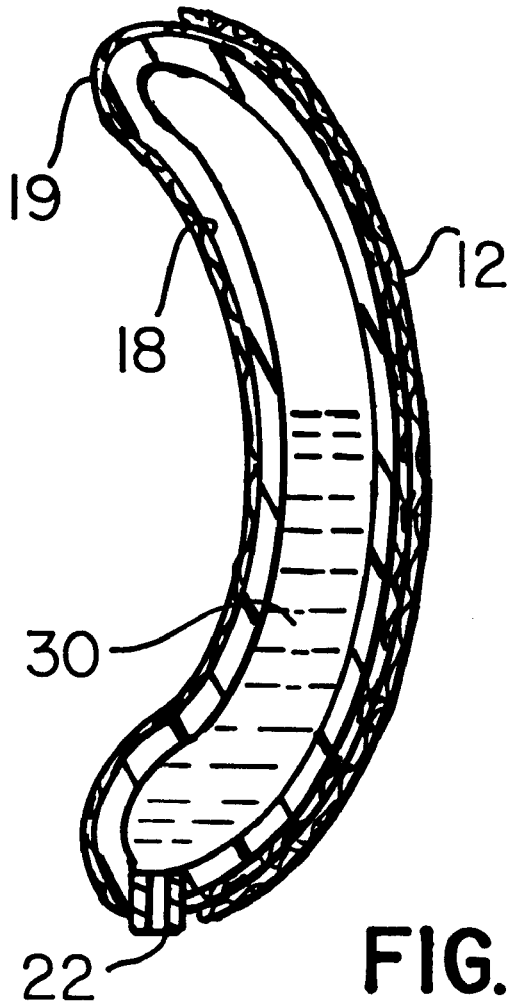
FIG. 2 is a vertical cross-sectional view taken along Line 2—2 of FIG. 1.

With reference to the views of FIGS. 1 and 2, the inventive bra 10 may be seen to include cup portions 12, shoulder straps 14 and a cup connecting element. 16.

Positioned within each bra cup 12 is a curved oblate flexible bladder 18 formed of a medical grade FDA approved material such as a silicone, a fabric sleeve or cover 19 therefore, an inlet 20, an outlet 22, and an outlet tube 24 which, in the embodiment of FIG. 1, will extend along the outer periphery of the bra cup, under bra strap 14, and through a VELCRO (hooker loop fastener material) loop 26 to an end point 28 (more fully discussed blow). The structure of the flexible bladder 18 may be more fully appreciated with reference to the vertical cross-sectional view of FIG. 2. Therein of the bladder 18 and bladder sleeve 19 (both positioned behind bra cup 12) may be seen to include a comestible liquid 30 which, by operation of gravity, will naturally attempt to exit through outlet 22. The function of bladder sleeve 19 (which is an optional element) is to enhance comfort to the wearer, in that a skin-silicone interface might otherwise cause some surface adhesion.

Figure 3:
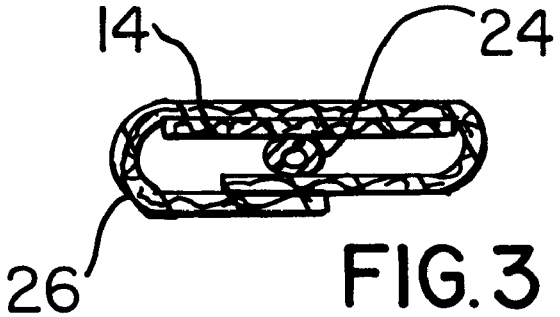
FIG. 3 is a horizontal cross-sectional view taken through the drinking tube taken along Line 3—3 of FIG. 1.

In the cross-sectional view of FIG. 3 is shown VELCRO loop 26 which is used to secure tube 24 beneath bra strap 14. It is to be appreciated that, if necessary, more than one VELCRO loop may be employed to assure proper positioning and stability relative to the bra strap 14. It is to be further appreciated that other mechanical means may also be employed to accomplish the same result, e.g., forming an internal channel about the bra periphery and within the bra strap.

With reference to FIG. 1 and the views which follow, it should be understood that, for purposes of simplicity of description, the inventive system is described with reference to a single side of each bra 10; however, it is contemplated that, in most instances, a symmetric structure would be employed upon the opposite side of the bra.

Figure 4:
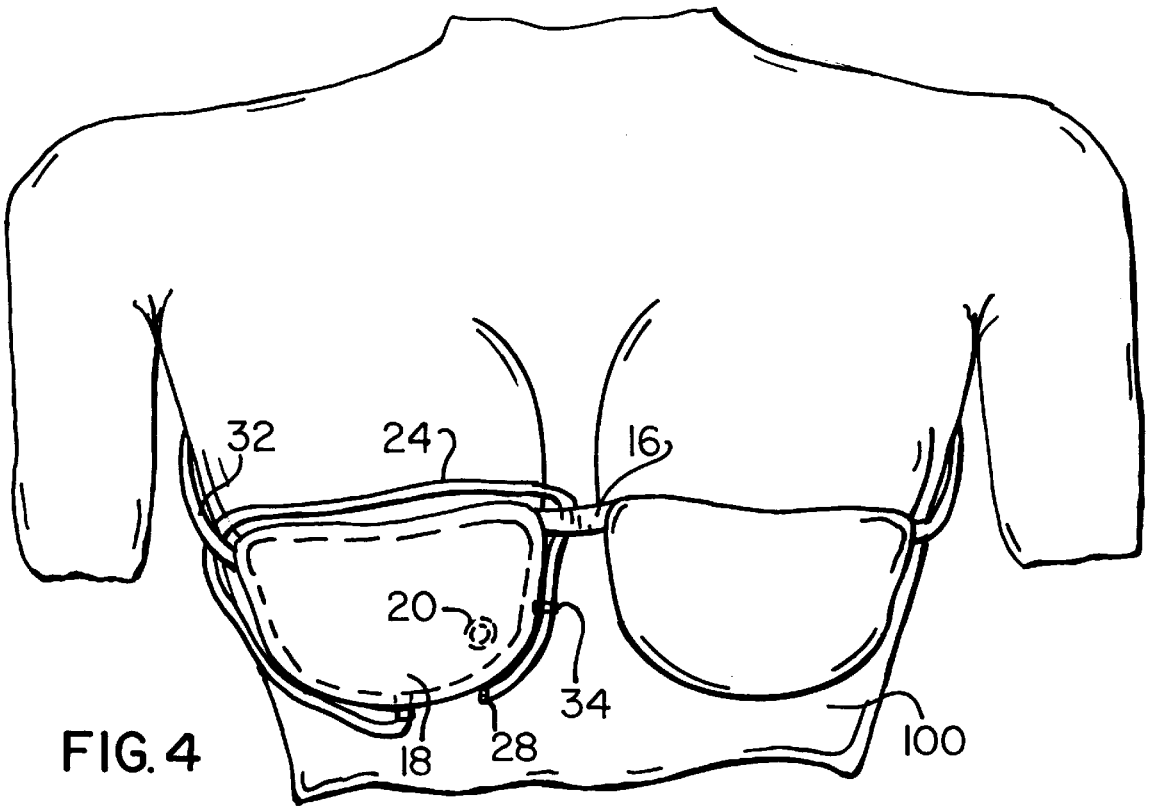
FIG. 4 is a view, similar to that of FIG. 1, however showing an alternate means of the storage of the drinking tube, adapted for use with strapless bras.

In FIG. 4 is shown a further embodiment of the invention regarding its use with a strapless bra 100 or comparable article of clothing as may occur in a bikini of bathing suit. Therein, tube 24 may be positioned circumferentially about essentially the entire bra cup, passing underneath bra back tie 32 and underneath bra cup connecting element 16. Therein, use is made of a small VELCRO element 34 which may take the form either of a loop or one part of a male-female VELCRO connection in which tube 24 is provided with one part of the VELCRO while element 34 is provided with the other complemental part. It is to be appreciated. that the tube positioning embodiments of FIG. 4 may also be employed with more conventional bra structures such as that above-described with reference to FIG. 1.

Figure 4A:
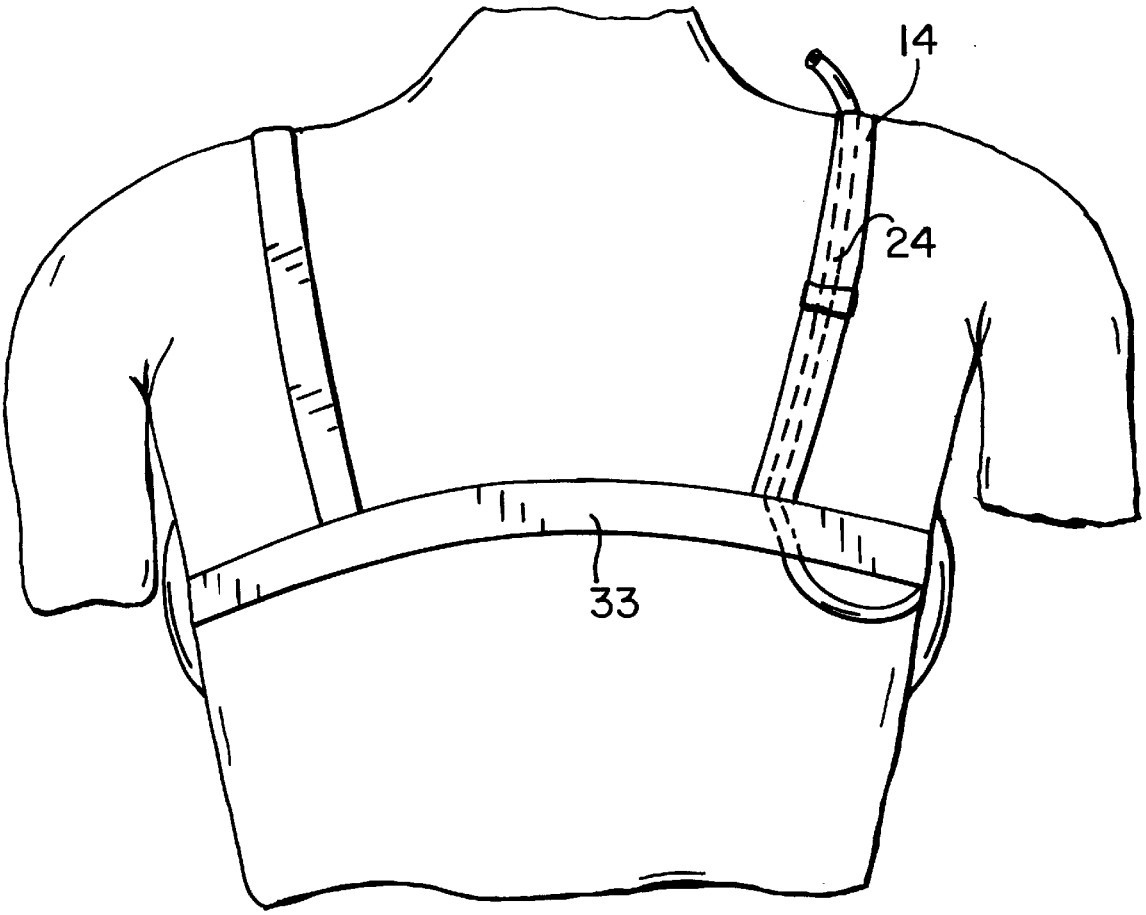
FIG. 4A is a view, similar to that of FIGS. 1 and 5, however showing the manner in which the drinking tube of the system may be placed along the back of the user.

With reference to FIG. 4A, there is shown a variation of the embodiment of bra 100 of FIG. 4. Therein, tube 24 is positioned behind the back of strap 14 of the user in which said VELCRO elements 26 or larger VELCRO loops of the type of the embodiment of FIG. 1 are employed to assure stability and positioning the tube relative to the shoulder straps 14 and back strap 33.

Figure 5:
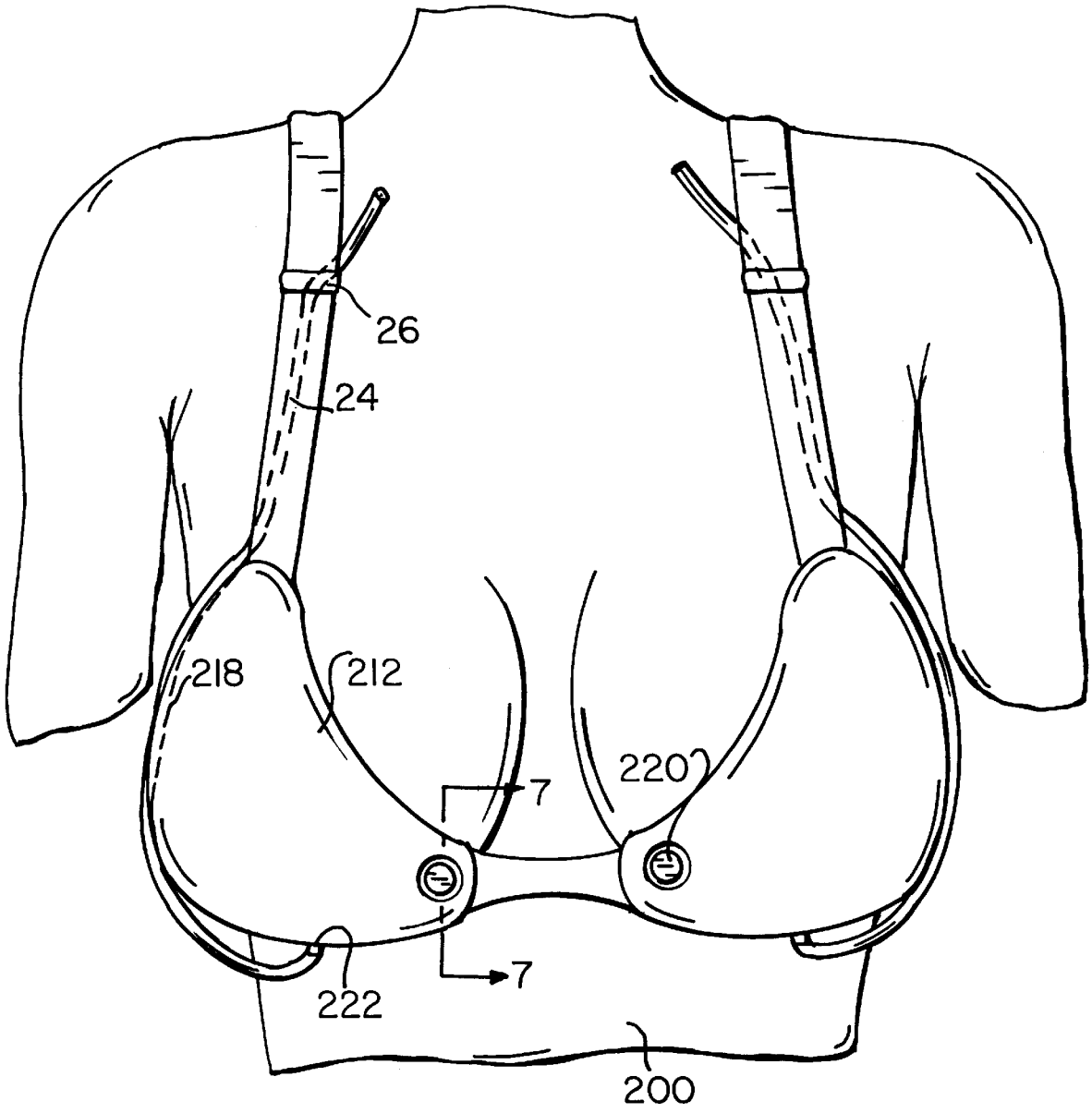
FIG. 5 is a front view, similar to that of FIG. 1, showing an embodiment in which the bladders are fully integrated into the bra cups. Also shown are separate tubes for the respective left and right sides of the bra.
Figure 7:
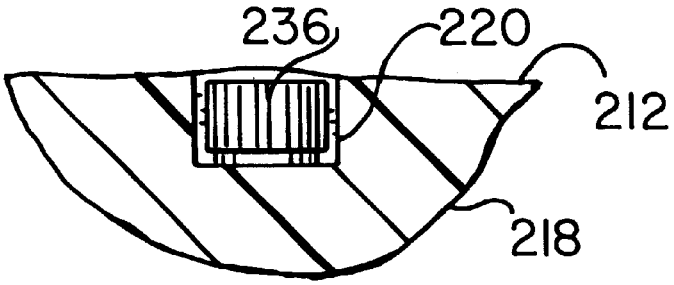
FIG. 7 is a cross-sectional view taken along Line 7—7 of FIG. 5.
Figure 9:
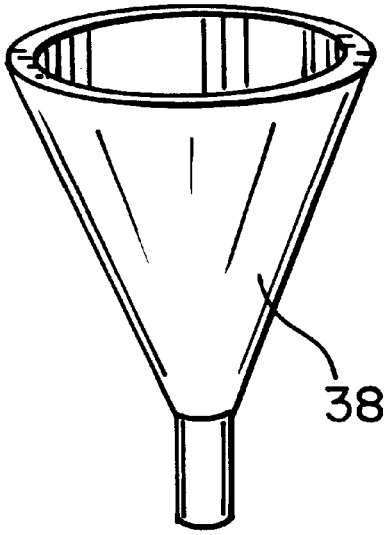
FIG. 9 is a perspective view of a flask usable in the filling of a bladder.

In FIG. 5 is shown a further embodiment of the invention which more particularly comprises a bra 200 in which bladders 218 are fully integrated into each bra cup 212, this in distinction to the embodiments of FIGS. 1 and 4 in which each of the bladders is removable from the bra cup 18. Accordingly, bra 200 reflects a manufactured structure whereas in the embodiments of FIGS. 1 and 4, bladders 18 would be selectably inserted behind bra cup 18 (see FIG. 2) simply on an "as needed basis." Further, The embodiment of FIG. 5 is similar to that of FIGS. 1 and 4 in that it is provided with both an inlet 220 and outlet 222. However, in the case of the embodiment of FIG. 5, inlet 220 should be accessible thru the bra cup thereby necessitating the structure of FIG. 7 which is a cross-sectional view taken along Line 7—7 of FIG. 5. Therein may be seen a plug 236 which is used to close inlet 220 after filling of the bladder 218 has been accomplished. Such filling may be facilitated through the use of a funnel 38 of the type shown in FIG. 9.

Figure 6:
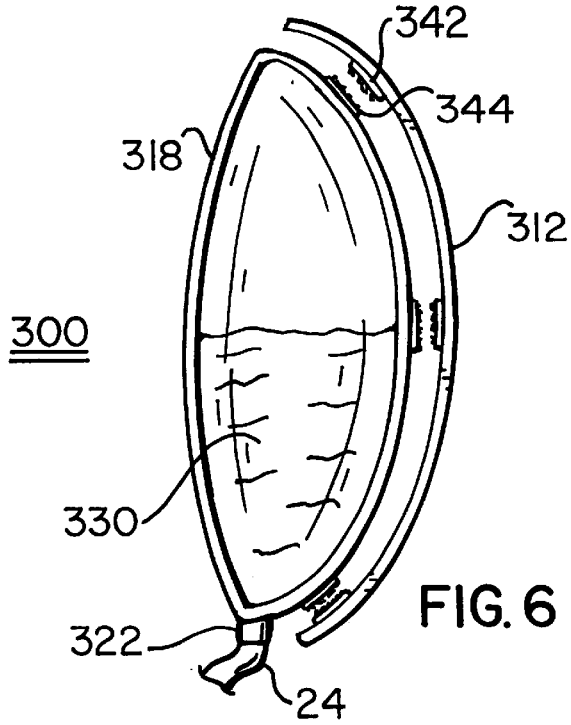
FIG. 6 is a cross-sectional schematic view showing a pre-filled modular disposable embodiment of the present system.

With reference to FIG. 6, there is shown an embodiment 300 of the invention in which there are provided pre-filled/modular bladders 318. In this embodiment, the bladders are discarded after the liquid content 330 has been consumed. Complemental VELCRO elements 342 and 344 assure securement of the bladders to the bra cups 312. It is believed that this embodiment will have particular use as a promotional vehicle for manufacturers and promoters of alcoholic beverages.

Figure 8:
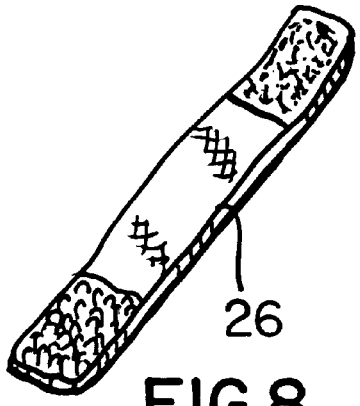
FIG. 8 is a perspective view of a VELCRO strap of the type shown in FIGS. 1 and 5 used for proper positioning of a drinking tube relative to a bra strap.
Figure 10:
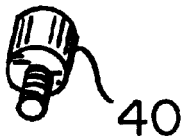
FIG. 10 is a plug used to assure closure at the end of a drinking tube.

It is noted that the VELCRO bra strap 26, above described with reference to FIGS. 1 and 3, is shown in an unfolded/open condition in the perspective view of FIG. 8. Shown in FIG. 10 is plug 40 which is used to assure that liquid 30 will not escape, or spill from end 28 of tube 24 when the system is not in use.

Figure 11:
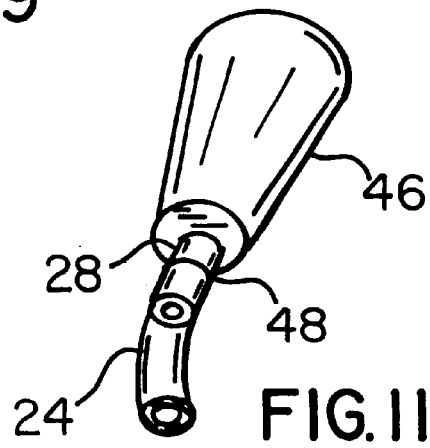
FIG. 11 is a mouthpiece device used to facilitate the sucking and drinking of liquid from a bladder tube.

With reference to FIG. 11, there is shown a mouthpiece 46 which may be used in combination with end 28 of outlet tube 24 to enable a user to fill the mouthpiece 46 with a quantity of comestible liquid stored within a bladder 18 prior to consumption thereof. In this embodiment, a plug of the type of plug 40 (see FIG. 10) may be employed at an inlet 48 of mouthpiece 46.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

Having thus described my invention, what I claim as new, useful, and non-obvious and, accordingly, secure by letters patent by the United States is:

1. A system for the securement of comestible liquids within cups of a bra, the system comprising:

(a) at least one a bra cup;

(b) at least one oblate flexible fluid-tight bladder formed of a medical grade material suitable for storage of comestible liquids, the bladder having a front lateral face deformable within an opposing inner surface of said bra cup, said bladder proportioned to fit within the size of said bra cup;

(c) inlet means for the filling of said bladder;

(d) outlet means of said bladder;

(e) tube means in fluid communication with said outlet bladder; and (f) means for securement and positioning of said tube relative to said bra.

2. The system as recited in claim 1 in which said inlet means of said bladder is positioned proximal to an element connecting bra cups of said bra.

3. The system as recited in claim 1 in which said outlet means of said bladder is disposed proximal to a lower edge thereof.

4. The system as recited in claim 2 in which said outlet means of said bladder is disposed proximal to a lower edge thereof.

5. The system as recited in claim 1 in which said comestible bladder is sewn into respective bra cups as an original aspect of manufacture thereof.

6. The system as recited in claim 1 further comprising:

means for the securement of said tube means underneath straps of said bra.

7. The system as recited in claim 1 further comprising:

means for securement of said tube means about a periphery of said bra cup.

8. The system as recited in claim 1 further including:

mouthpiece means for securement to an end of said tube means opposite said bladder outlet end.

9. A system for the securement of comestible liquids within cups of bra, the system comprising:

(a) at least one bra cup;

(b) at least one oblate flexible bladder formed of a medical grade material suitable for storage of comestible liquids, the bladder having a front lateral face deformable within an opposing inner surface of said bra cup, said bladder proportioned to fit within the size of said bra cup;

(c) outlet means of said bladder;

(d) tube means in fluid communication with said outlet means; and (e) means for securement and positioning of said tube relative to said bra.

10. The system as recited in claim 9 in which said front lateral face of said bladder and said opposing inner surfaces of said bra cup include complemental securement means.

11. The system as recited in claim 9 in which said outlet means of said bladder is disposed proximal to lower edge thereof.

12. The system as recited in claim 11 in which said front lateral face of said bladder and said opposing inner surfaces of said bra cup include complemental securement means.

13. The system as recited in claim 9 further comprising:

means for the securement of said tube means underneath straps of said bra.

14. The system as recited in claim 9 further comprising:

means for securement of said tube means about a periphery of said bra cup.

15. The system as recited in claim 9 further including:

mouthpiece means for securement to an end of said tube means opposite said bladder outlet end.

16. The system as recited in claim 1 in which said flexible bladders include a fabric cover.

17. The system as recited in claim 5 in which said flexible bladders include a fabric cover.

* * * * *